United States Patent [19]

Taibi

[11] 3,945,619

[45] Mar. 23, 1976

[54] MOBILE CONTINUOUS CONCRETE PROPORTIONING PLANT

[76] Inventor: Frank P. Taibi, 829th Circle, Lewiston, N.Y. 14092

[22] Filed: Mar. 3, 1975

[21] Appl. No.: 554,515

[52] U.S. Cl. ..... 259/154; 214/2; 214/17 R; 259/167

[51] Int. Cl.[2] ..... B28C 7/04

[58] Field of Search ..... 259/154, 149, 148, 152, 259/154, 160, 161, 162, 164, 165, 167; 214/2, 17 R, 501

[56] References Cited

UNITED STATES PATENTS

| | | | |
|---|---|---|---|
| 3,189,327 | 6/1965 | Domenighetti | 259/154 |
| 3,251,484 | 5/1966 | Hagan | 259/154 |
| 3,295,698 | 1/1967 | Ross | 214/2 |
| 3,343,688 | 9/1967 | Ross | 214/2 |
| 3,476,270 | 11/1969 | Cox | 214/2 |
| 3,603,567 | 9/1971 | Sackett | 259/154 |

*Primary Examiner*—Robert W. Jenkins
*Attorney, Agent, or Firm*—Wilkinson, Mawhinney & Theibault

[57] ABSTRACT

The present disclosure is directed to a continuous concrete proportioning plant of the mobile type movable from job site to job site not requiring extensive site preparation. The primary frame has a compact combination of cement sand and aggregate systems which permits sand and aggregate trucks to be backed onto a three sided hopper for each material which when charged is lifted and tilted toward the center of the machine where it feeds a belt conveyor running longitudinally toward the front of the machine. Each belt system contains a continuous belt weighing device and a totalizer will stop and/or clear the conveyor when a predetermined amount is attained. The sand and aggregate hoppers may be tilted to achieve the best flow rate through metering gates.

5 Claims, 9 Drawing Figures

MOBILE CONTINUOUS CONCRETE PROPORTIONING PLANT

An object of the present invention is the provision of a mobile continuous concrete proportioning plant the transfer and set up time of which from job site to job site is minimal since it does not require extensive site preparation such as concrete footings, pits in the ground or power connections.

A further object of the present invention is the provision of a concrete proportioning plant for mobile transport in which the sand and aggregate systems are compactly to each side of the cement system during transport mode and which when on the job site the sand and aggregate may be charged directly from the trucks hauling the material by dumping directly from the truck into the respective hopper which may be telescopically extended to accommodate a full truck load (approx. 20 tons) and the hopper elevated about a pivot to the main plant frame to charge the sand and aggregate conveyor belts at varying load and batch requiring rates.

A still further object of the present invention is the provision of a mobile plant as described above having at least one cement silo storage and conveyor weigh and metering systems which lends to compact construction and good weight distribution on the main frame of the plant.

With the foregoing objects in view the invention will be more fully described hereinafter and more particularly pointed out in the appended claims.

In the drawings in which like parts are denoted by reference characters throughout the several views.

Figure 1:
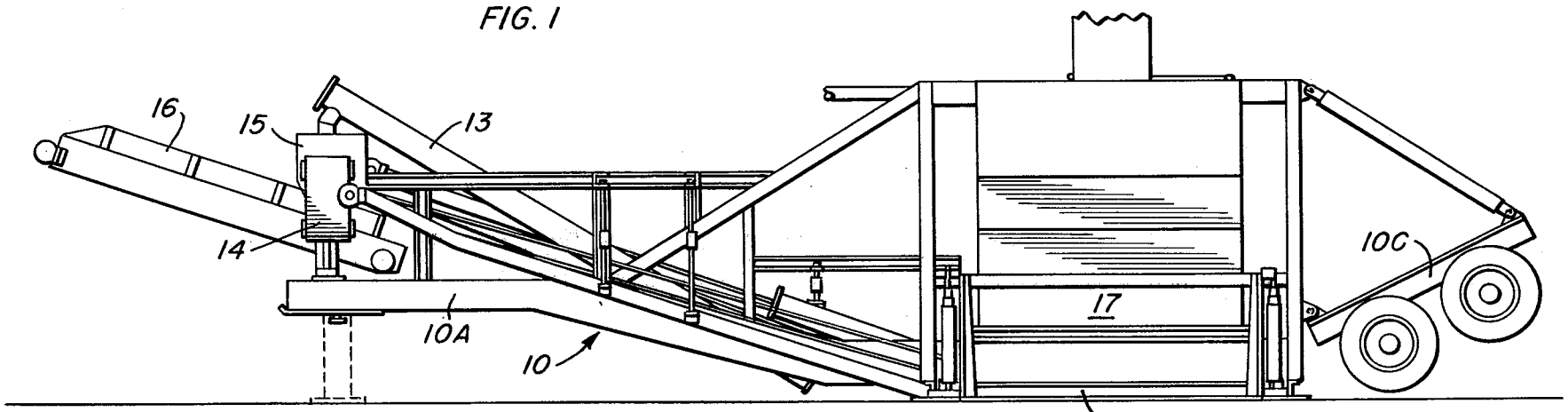
FIG. 1 is a side elevational view of the plant of the present invention with transport wheels up at a job site location ready for batching.
Figure 2:
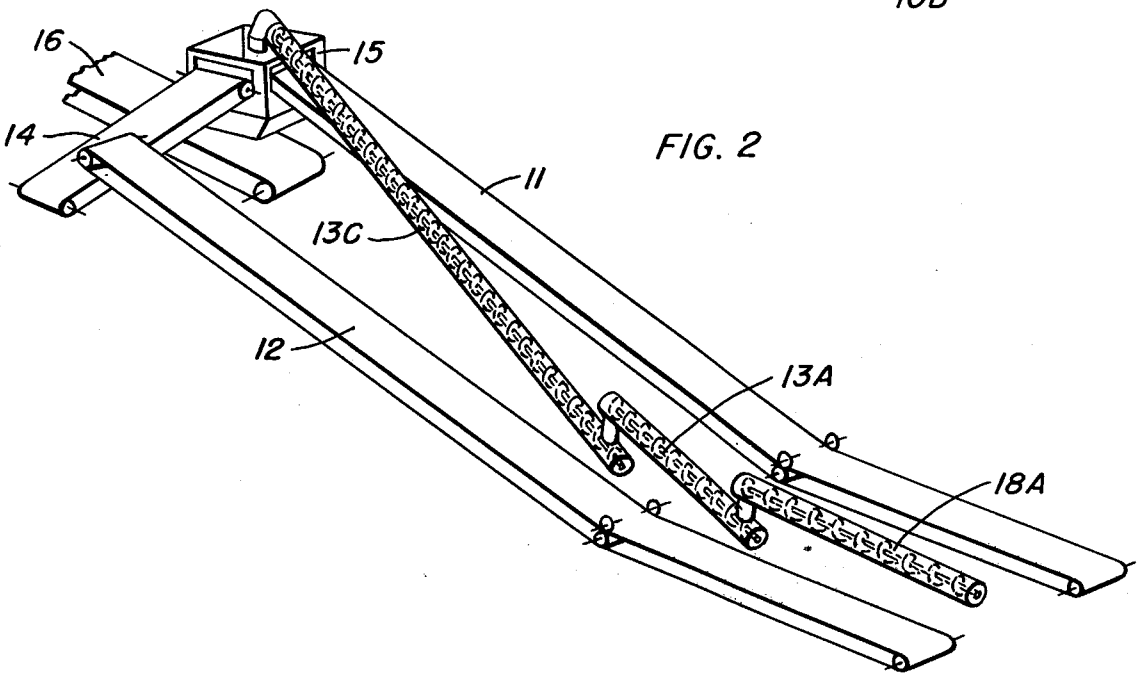
FIG. 2 is a mechanical perspective schematic of the plant of FIG. 1, showing the sand and aggregate conveying and weighing system relative to the cement, mixing and distribution system.
Figure 3:
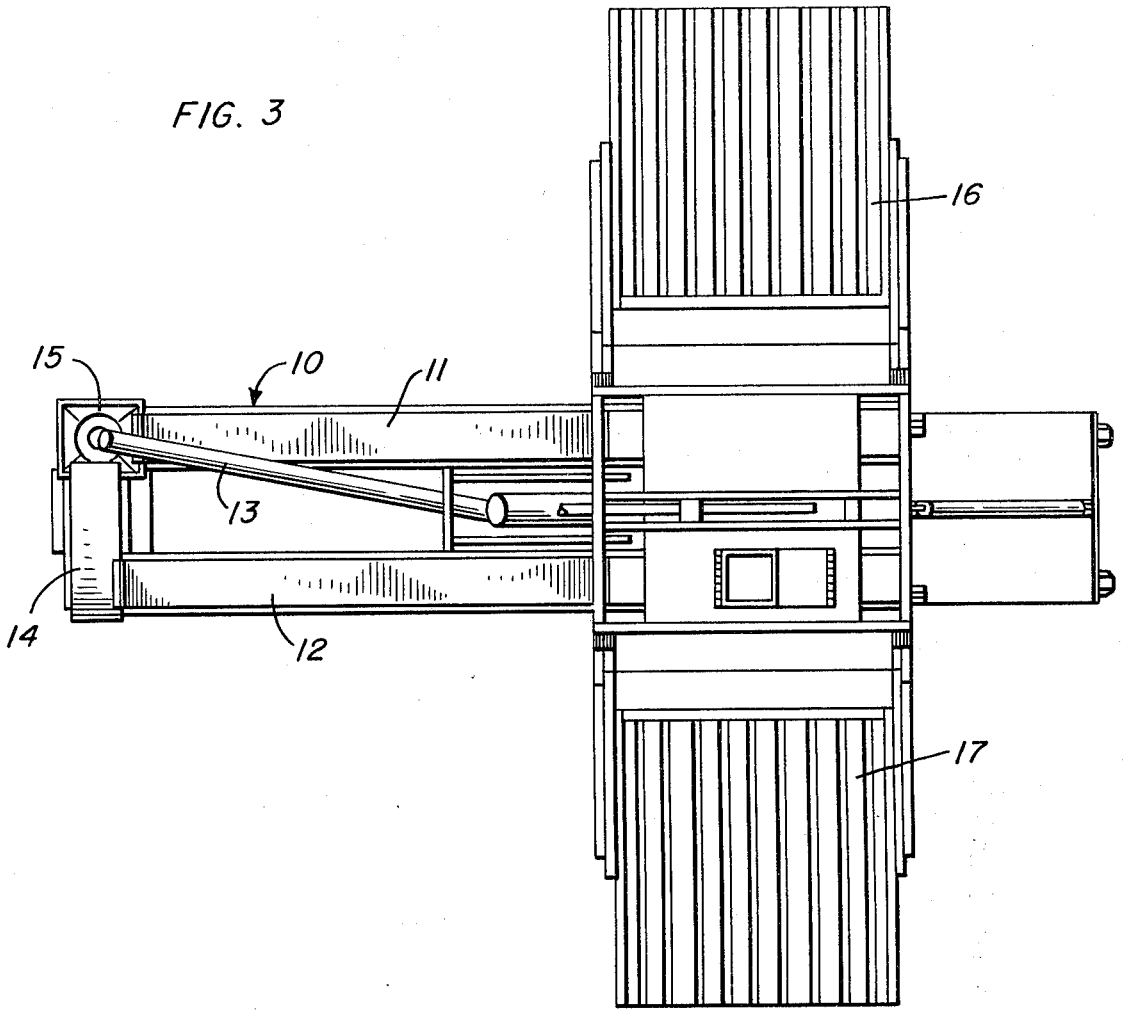
FIG. 3 is a top plan view of the plant of FIG. 1 with the sand and aggregate hoppers in their rigged out charging position.
Figure 4:
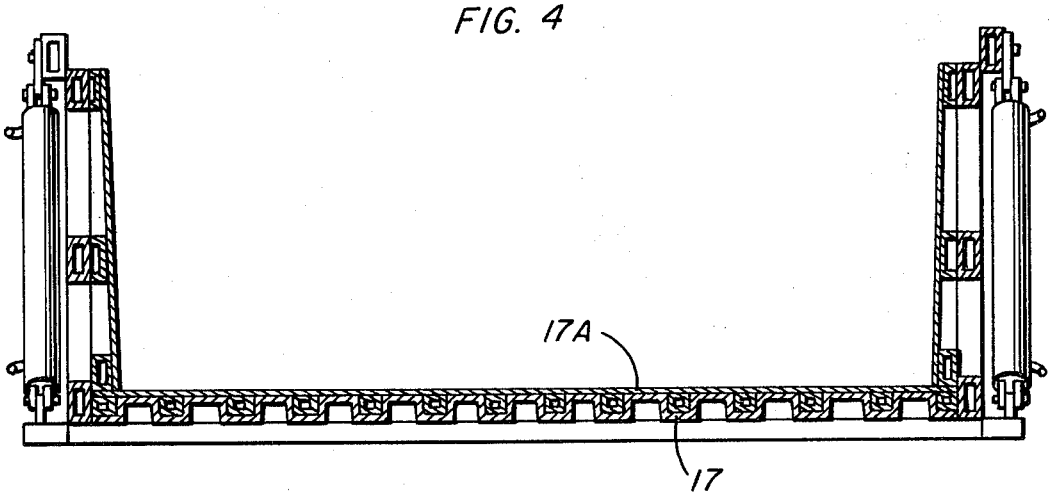
FIG. 4 is a vertical transverse sectional view taken through the sand and aggregate hoppers showing their telescopic construction and elevating mechanism.

Referring now to the drawings and for the moment to FIGS. 1 through 3 inclusive, 10 represents the plant main frame having an upper forward portion 10A and a rear lower portion 10B. An aggregate conveyor transport and weighing belt system is shown at 11 and a sand conveyor transport and weighing system is shown at 12.

Lying therebetween is a cement conveyor and weigh screw system 13. At the upper end or forward end a transverse conveyor 14 moves the sand from conveyor 12 over to the collecting hopper 15 where it is combined with aggregate and cement after which the resultant mix is moved on distributor conveyor 16 to either a large mixer or waiting vehicles.

Figure 5:
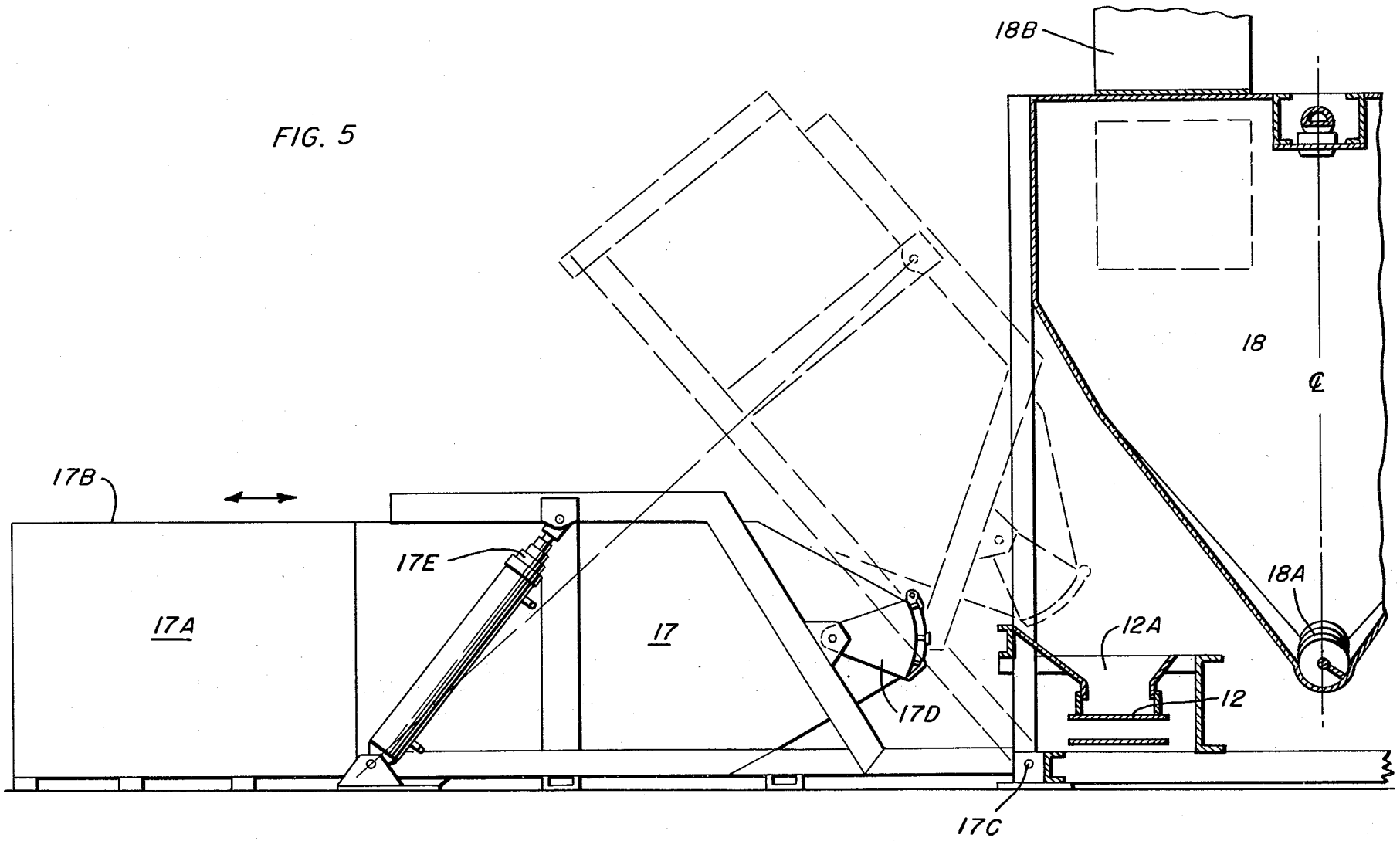
FIG. 5 is a fragmentary vertical transverse sectional view through the plant main frame at the cement silo area showing the sand hopper in solid line charging position and in dash line metering position.

As best seen in FIGS. 3 and 5, the endless belt conveyors 11 and 12 are charged with their respective materials from hoppers 16 and 17 which are of telescopic construction, by way of example in FIG. 5, 17 and 17A, the sections 17A being movable in the direction of the arrows and the portion 17B being open for charging with sand from a truck. The end of the hopper 17 nearest the pivot 17C to the main frame has a metering gate 17D to regulate the rate of flow of sand through a charging mouth 12A onto the endless belt conveyor 12.

Hydraulic telescopic cylinders and rams 17E raise the hopper from the solid to the dash line position where under either hydraulic or pneumatic control the hopper contents are metered onto the conveyor belt for its trip to the collecting hopper 15.

Since both hoppers 16 and 17 are identical and each is equidistant from the center line of the plant only one has been shown in detail in FIG. 5.

Figure 6:
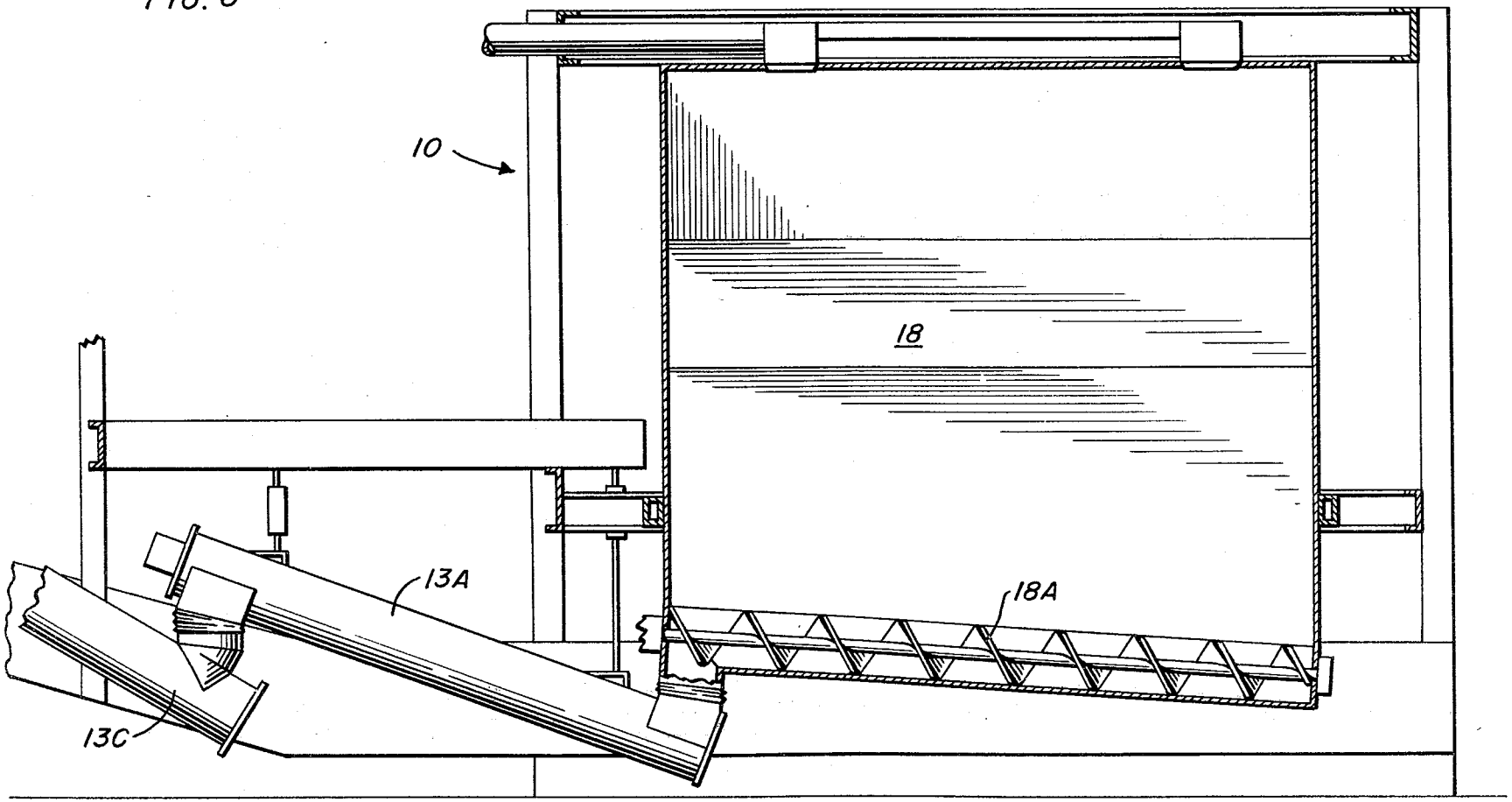
FIG. 6 is a fragmentary longitudinal sectional view of the cement silo, conveying and weighing screw system in place on the main frame.
Figure 7:
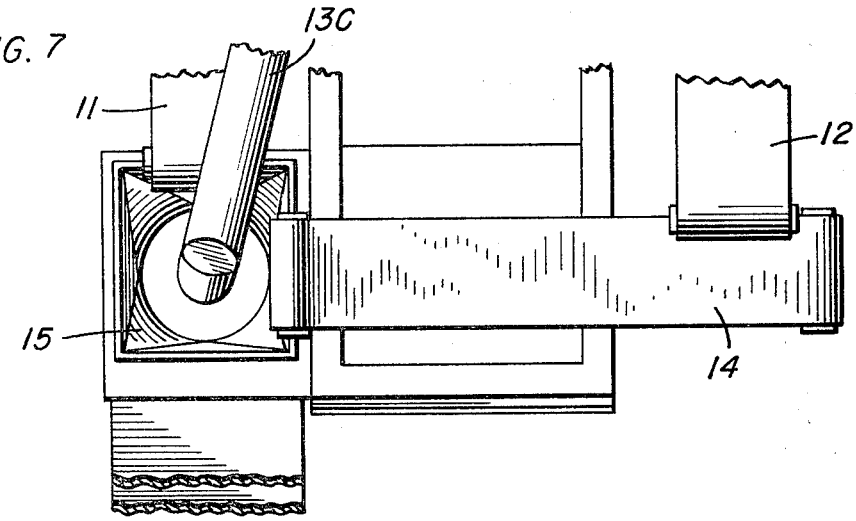
FIG. 7 is a top plan view of the upper forward end of the plant showing the relationship of the sand, aggregate, cement and mixing systems.
Figure 8:
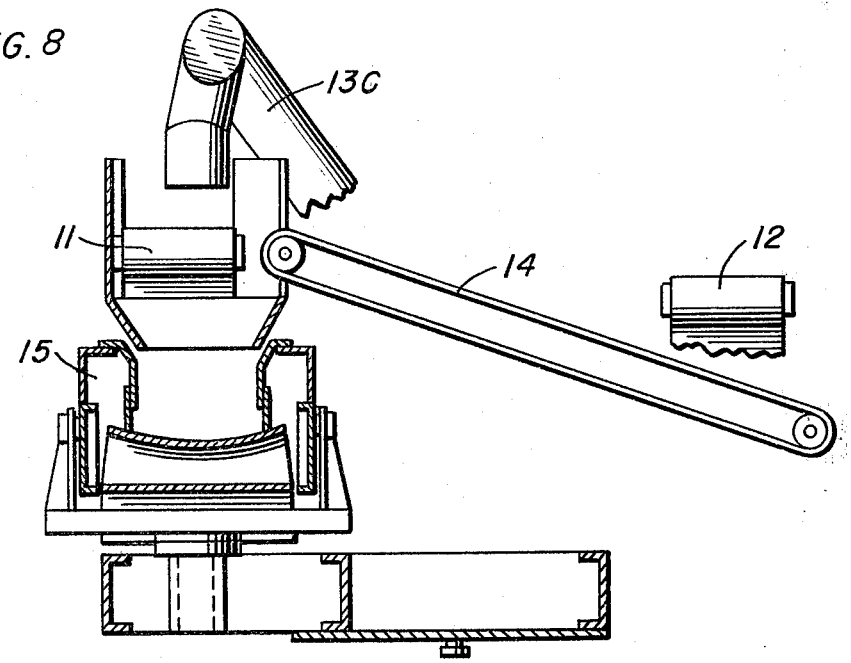
FIG. 8 is a front elevational view of the components of FIG. 7.
Figure 9:
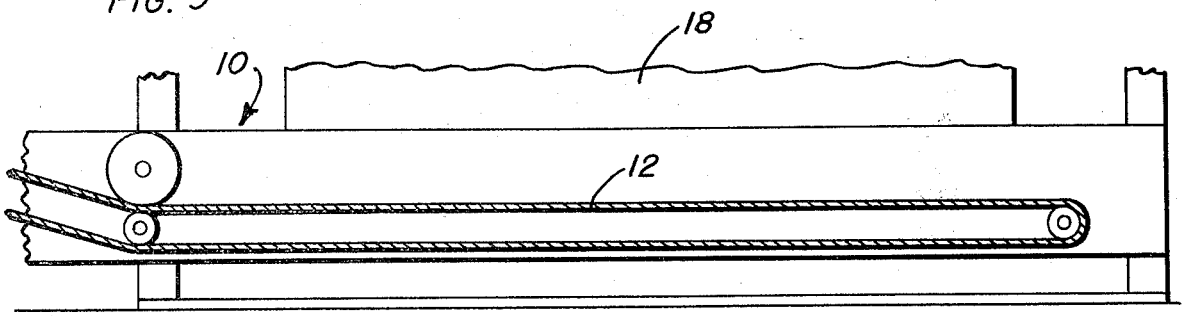
FIG. 9 is a fragmentary longitudinal sectional view of the sand conveyor belt beneath the cement silo area of the main frame.

As best seen in FIG. 6 the cement silo 18 is shown mounted in the main frame 10. While only one silo has been shown two may be employed in tandem in which each is provided with a conveyor screw 18A for advancing the powdered cement to the weighing conveyor 13A where it is measured by a load cell system and thence to conveyor screw 13C up to the collecting hopper 15.

OPERATION

The aggregate and sand subsystems operate identically on opposite sides of the plant. One system will be described. Trucks delivering rock (or sand) are backed onto a three sided hopper 16,17 capable of receiving a full truck load (approx. 20 tons). After the truck has cleared the way, the hopper 16, 17 is lifted and tilted toward the center of the machine (see FIG. 5) where it feeds a belt conveyor 11,12 running longitudinally toward the front of the machine. The belt conveyor contains a continuous belt weighing device and a totalizer which will stop and/or clear the conveyor when a preset amount is reached and control the tilt of the hoppers 16, 17 and the opening of the gates 16D,17D to achieve the best flow rate.

The cement is contained in one or more silos 18 in the center of the machine frame 10. Each silo 18 contains a screw conveyor 18A feeding a simple conveyor 13A which continually totalizes the amount of cement delivered and turns the feeders off when a preset amount has been reached.

All materials except water are combined at a point to the front of the machine where they can be fed into a waiting vehicle or a stationary mixer by means of a pivoted telescoping belt conveyor.

When the machine is to be moved to a new job site, the receiving hoppers 16,17 telescope and fold into the machine, hydraulic jacks raise the plant to travel position, and the running gear 10C locks in the down transport position. A standard fifth wheel tractor can tow the plant to the new location.

Cement is delivered pneumatically to the silo 18. Filtering of the conveying air is provided in the top of the cement silo.

All motors and actuators are operated hydraulically; the hydraulic pump can be powered by a gasoline engine or an electric motor. The weighing devices require 115 volt A C.

What I claim is:

1. A mobile concrete proportioning plant comprising an elongated primary frame having retractable transport wheels at one end and a towing fifth wheel at the other end, cement silo means proximate the rear of said primary frame extending transversely thereof and dischargable substantially centrally thereof, a sand belt conveyor system along one side of said primary frame, an aggregate belt conveyor system along the other side of said primary frame, a three sided telescopic aggregate hopper pivoted to said main frame adjacent the aggregate belt conveyor having means for tilting said hopper to discharge aggregate onto said conveyor, a three sided telescopic sand hopper pivoted to said main frame adjacent said sand belt conveyor having means for tilting said hopper to discharge sand onto said sand belt conveyor, collecting hopper means proximate the front of said primary frame positioned to receive cement from said silo means and sand and aggregate from their respective conveyor belts for collecting and discharge upon a concrete distributor, and means connected between said pivoted telescopic sand and aggregate hoppers for maintaining them in the fully raised rigged in condition for over the highway transport.

2. A mobile concrete proportioning plant as claimed in claim 1 further comprising cement conveyor weighing and conveyor means between said cement silo means and mixing means passing between said sand and aggregate conveyor belt means for delivering cement from said cement silo for combining the cement with the sand and aggregate at the collecting hopper means.

3. A mobile concrete proportioning plant as claimed in claim 1 wherein said sand and aggregate belt conveyors have horizontal runs under the cement silo means and inclined runs from the cement silo means up to the mixer means.

4. A mobile concrete proportioning plant as claimed in claim 3 wherein said telescopic sand and aggregate hoppers are pivoted to the primary frame adjacent the horizontal runs of the sand and aggregate belt conveyors beneath the cement silo means.

5. A mobile concrete proportioning plant as claimed in claim 1 wherein said three sided sand and aggregate hoppers have an open side which when in the rigged out job site operating position defines an open top into which sand and aggregate trucks dump their loads, metering gates at the end of each hopper closest their pivotal connection to the main frame, and hopper tilting means between said main frame and hopper to raise the telescoping end of the hopper to discharge sand and aggregate through the metering gates onto the respective conveyor belt.

* * * * *